US010526154B2

(12) United States Patent
Hachmann et al.

(10) Patent No.: US 10,526,154 B2
(45) Date of Patent: Jan. 7, 2020

(54) WINDING MACHINE FOR WINDING LENGTHS OF MATERIAL

(71) Applicant: TRUETZSCHLER GMBH & CO. KG, Moenchengladbach (DE)

(72) Inventors: Andreas Hachmann, Schloss Holte-Stukenbrock (DE); Manfred Penkert, Leopoldshoehe (DE)

(73) Assignee: TRUETZSCHLER GMBH & CO. KG, Moenchengladbach (DE)

( * ) Notice: Subject to any disclaimer, the term of this patent is extended or adjusted under 35 U.S.C. 154(b) by 278 days.

(21) Appl. No.: 15/531,399

(22) PCT Filed: Oct. 31, 2015

(86) PCT No.: PCT/EP2015/002194
§ 371 (c)(1),
(2) Date: May 26, 2017

(87) PCT Pub. No.: WO2016/082910
PCT Pub. Date: Jun. 2, 2016

(65) Prior Publication Data

US 2017/0341893 A1 Nov. 30, 2017

(30) Foreign Application Priority Data

Nov. 28, 2014 (DE) ..... 10 2014 117 522

(51) Int. Cl.
*B65H 19/28* (2006.01)
*B65H 18/14* (2006.01)
*B65H 18/06* (2006.01)

(52) U.S. Cl.
CPC ..... *B65H 18/145* (2013.01); *B65H 19/28* (2013.01); *B65H 18/06* (2013.01);
(Continued)

(58) Field of Classification Search
CPC ..... B65H 18/06; B65H 18/145; B65H 19/28; B65H 2403/25
See application file for complete search history.

(56) References Cited

U.S. PATENT DOCUMENTS 2,792,996 A 5/1957 Lorig
2,890,003 A 6/1959 Jones
(Continued)

FOREIGN PATENT DOCUMENTS

CN 1927683 A 3/2007
DE 12 28 885 B 11/1966
(Continued)

OTHER PUBLICATIONS

International Search Report for PCT/EP2015/002194, dated Feb. 9, 2016, and English Translation thereof.
(Continued)

*Primary Examiner* — Sang K Kim
(74) *Attorney, Agent, or Firm* — FisherBroyles, LLP; Robert Kinberg

(57) ABSTRACT

The invention relates to a winding machine for winding material webs, in particular foils or films, wherein the winding machine comprises a feeder system with a first belt feeder which, during the winding of the material web around a winding core in a first direction, wraps itself at least partially around the material web. The feeder system comprises a second belt feeder which is suitable for winding the material web in a second direction around the winding core.

14 Claims, 5 Drawing Sheets

(52) U.S. Cl.
CPC ..... *B65H 2301/4146* (2013.01); *B65H 2301/41422* (2013.01); *B65H 2403/25* (2013.01); *B65H 2403/942* (2013.01)

(56) References Cited

U.S. PATENT DOCUMENTS

| | | | | | |
|---|---|---|---|---|---|
| 3,905,218 | A | * | 9/1975 | Galletti | B21C 47/063 72/148 |
| 3,913,367 | A | * | 10/1975 | Galletti | B21C 47/063 242/532.7 |
| 6,082,659 | A | * | 7/2000 | Sankaran | B21C 47/245 242/527.2 |
| 2009/0008493 | A1 | | 1/2009 | Frische et al. | |
| 2010/0044492 | A1 | | 2/2010 | Zheng | |

FOREIGN PATENT DOCUMENTS

| | | | |
|---|---|---|---|
| DE | 10 2004 049329 | A1 | 4/2006 |
| DE | 21 2005 000029 | U1 | 2/2007 |
| EP | 2 803 609 | A1 | 11/2014 |
| GB | 2 006 165 | A | 5/1979 |

OTHER PUBLICATIONS

Written Opinion for PCT/EP2015/002194, dated Feb. 9, 2016.
First Office Action for Chinese Patent Application No. 201580055199.0 dated Sep. 30, 2017.

* cited by examiner

WINDING MACHINE FOR WINDING LENGTHS OF MATERIAL

CROSS-REFERENCE TO RELATED APPLICATIONS

This application is a U.S. National Stage of International Patent Application No. PCT/EP2015/002194, filed Oct. 31, 2015, designating the United States and claiming benefit of German Patent Application No. 10 2014 117 522.0, filed Nov. 28, 2014.

BACKGROUND OF THE INVENTION

The invention relates to a winding machine for winding material webs, in particular foils or films, having a feeding system comprising a first belt feeder which, during the winding of the material web around a winding core, wraps itself in one direction at least partially around the material web.

For the winding of material webs, winding machines are provided with one or several contact rolls which rest on the material web and press the air out during the winding operation. With extremely thin foils, which are especially elastic, a different tension can build up over the width of the material web as a result of a non-uniform thickness profile during the production, caused by temperature fluctuations. Contact rolls are not suitable for use with these thin foils since they are extremely inflexible and exert the same pressure over the complete winding width onto the foil.

To support the winding operation with thin foils, feeder systems are known which press with a plurality of side-by-side arranged belts onto the foil. To be sure, these belts are driven by a joint drive, but are flexible enough, so that they can exert a differing pressure onto the thin foils over the winding width of the material web. Tensions caused by differences in the thickness profile do not increase in this way. These feeder systems, however, have the disadvantage of being configured only for one winding direction. A further disadvantage is the limited flexibility for different winding diameters.

SUMMARY OF THE INVENTION

It is the object of the invention to create a winding machine provided with a feeder system which is suitable for the winding in two directions and for different winding diameters.

The above and other objects are achieved according to an embodiment of the invention by the provision of a winding machine with a feeder system for winding a material web of foil or film around a winding core, comprising: at least one circulating belt; a first belt feeder constructed and arranged to wrap the at least one circulating belt at least partially around the material web during a winding of the material web around the winding core in a first direction; and a second belt feeder constructed and arranged to wind the material web in a second direction around the winding core.

Thus, the invention involves a winding machine that comprises for the winding of material webs, in particular foils, a feeder system with a first belt feeder which at least partially wraps itself around the material web during the winding of the web around a winding core in a first direction.

According to an embodiment of the invention, a feeder system is provided that comprises a second belt feeder which is suitable for winding the material web in a second direction around the winding core. As a result, it is possible to determine very quickly and without having to take retrofitting measures, e.g. for coated material webs, on which side the coating should come to rest during the winding operation.

The first direction for the wrapping around can be in clockwise direction, for example, so that the second direction in which the material web is wrapped by the second belt feeder can be counter-clockwise, and vice versa.

The first and the second belt feeder preferably can respectively comprise at least two levers, between which a circulating belt is arranged. Both belt feeders thus can admit the material web with a flexible tension over the width. It is furthermore possible to wind strips of material webs in both winding directions.

According to a further embodiment, the circulating belt is an endless belt which circulates between respectively two levers of the first and the second belt feeder. Even though only a single belt feeder is engaged each time, the second belt feeder which is in the rest position, ensures a maximum angle of the wrapping of the belt around the material web because of the belt guidance.

The levers are preferably embodied as two-sided, centrally positioned levers, thus making it possible to wind up a large, variable diameter range.

In one embodiment, the levers are positioned with the aid of two coupling links, which allows determining a precise pivoting range for the lever. The pivoting range becomes smaller as a result of the second coupling link, resulting in a very compact belt feeder.

A combination of both lever systems, wherein the first belt feeder is provided with two-sided, centrally positioned levers, and the second belt feeder is provided with levers positioned via two coupling links, allows realizing at least in one winding direction a large winding range with a variable diameter while, at the same time, the feeder system of the winding machine does not require too much space.

Via the pressure elements, arranged in the region of the lever heads, additional pressure can be exerted onto the material web to be wound up. The pressure element can be embodied as force-loaded or spring-loaded elements. In an embodiment, the pressure elements are embodied as spring plates which can enlarge in the manner of a finger the wrap-around area of the feeder system where pressure is applied.

With the aid of the pivotable arrangement of the feeder system on the winding machine, a position protecting the material web can be assumed for exchanging and/or newly inserting the winding core.

BRIEF DESCRIPTION OF THE DRAWINGS

The invention is explained in further detail with the aid of the enclosed drawings, which show in.

DETAILED DESCRIPTION OF THE INVENTION

Figure 1:
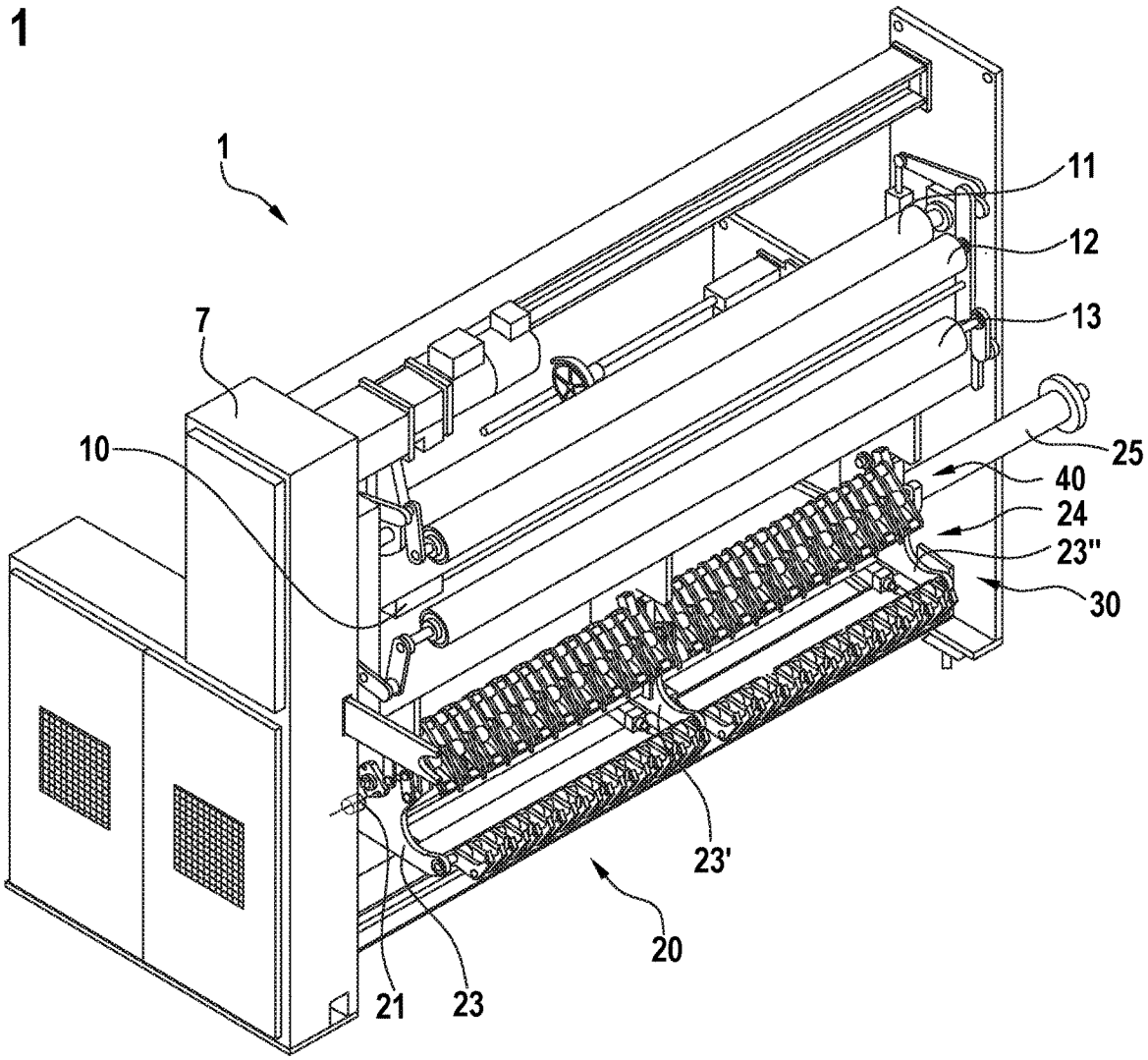
FIG. 1 is a perspective view of a winding machine.
Figure 2:
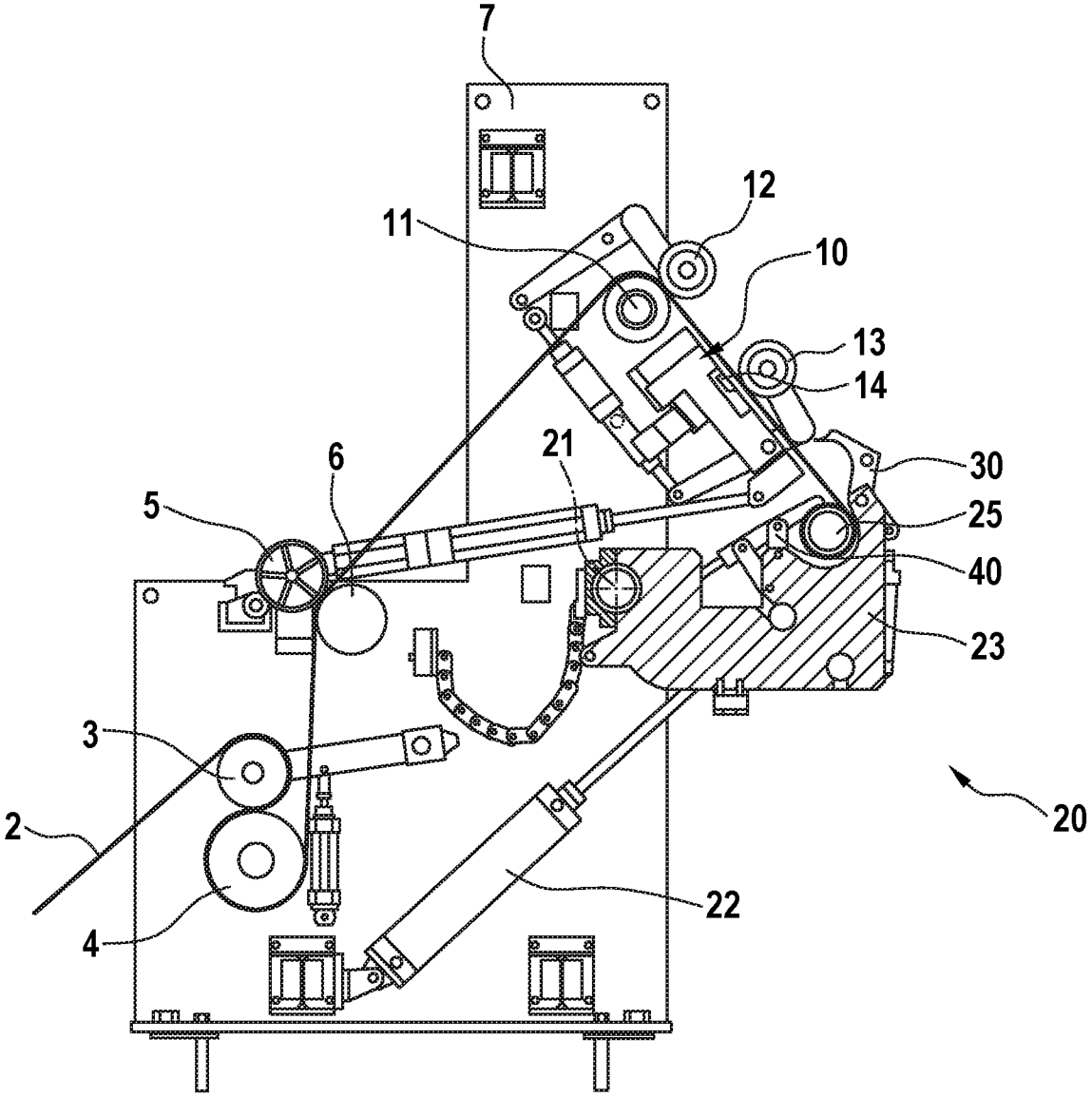
FIG. 2 is a section through the winding machine, in a view from the side.

According to FIGS. 1 and 2, a material web 2, for example a plastic foil or film, enters the winding machine 1 and initially moves around a traction mechanism, which consists of a tilt-mounted and pneumatically charged clamping roll 3 with a lower roll 4 that exerts a constant tension onto the material web 2. The material web 2 is furthermore guided between two guide rolls 5, 6 provided with a length-measuring device, not shown herein, for determining the length of the material web 2 that enters the winder 1. The material web 2 is furthermore moved to a cross cutter 10 where the material web 2 is clamped between two rolls 11, 12 and is conveyed to the feeder system 20 where it can be wound around a winding core 25 or a winding sleeve. The cross cutter 10 is pivotally hinged to the frame 7 of the winding machine 1 and comprises a cutting device which cuts the material web 2 transverse to the longitudinal direction and/or the transporting direction. The rolls 12, 13 which are designed to generate pressure that is exerted onto the material web 2, are positioned pivotally hinged on a lever system to make space for inserting the material web 2. The roll 11 advantageously can be designed as a driven roll.

The feeder system 20 comprises at least two support plates 23, 23' which are connected to several shafts and/or axes. Shown for this exemplary embodiment are three support plates 23, 23', 23", which are arranged on the frame 7 of the winding machine 1, to pivot around a pivoting point 21 with the aid of at least one adjustment means 22, for example a pneumatic cylinder or an eccentric drive. The support plates 23, 23', 23" are provided with an opening 24 for accommodating a winding core 25 which can be driven outside of the winding machine 1.

A first and a second belt feeder 30, 40 are arranged on both sides of the opening 24 and/or parallel to the longitudinal axis of the winding core 25.

Figure 3:
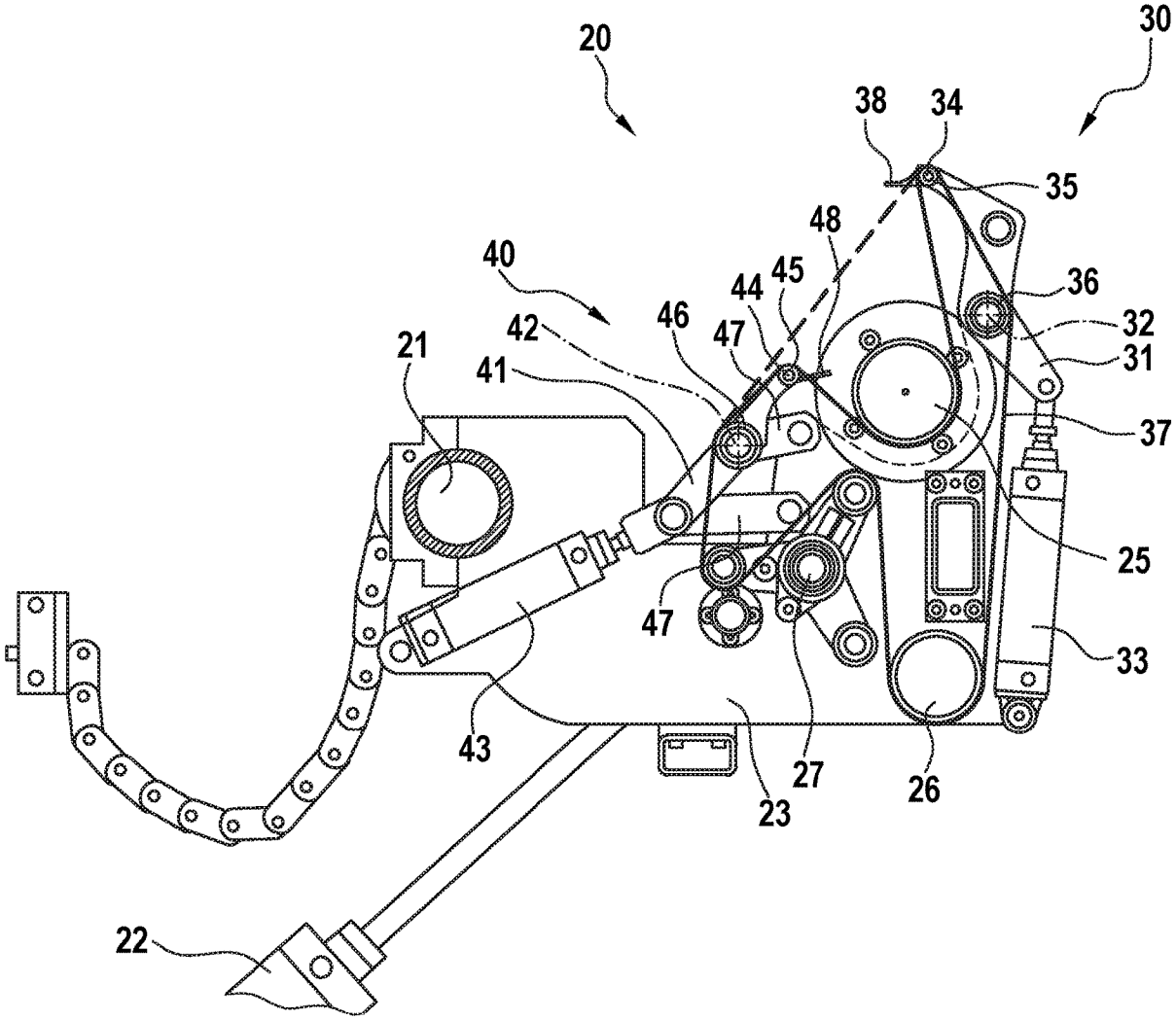
FIG. 3 is a representation of a detail of the feeder system.

The first belt feeder 30 shown in FIG. 3 comprises at least two levers 31, 31' (see FIG. 4) of which only the lever 31 is visible in FIG. 3. The levers 31, 31' of the first belt feeder 30 are embodied as two-sided levers, wherein a head 34 with a pressure element 38 in the form of a spring plate is arranged on one lever end and an adjustment means 33 in the form of a pneumatic cylinder engages on the other end. The pressure element 38 can also be arranged between two levers 31', 31". Each lever 31, 31' is positioned pivoting via a pivoting point 32, so that when the adjustment means 33 is actuated, the heads 34 of the levers 31, 31' carry out a pivoting movement. A deflection roll 35 is furthermore installed at the head 34 of each lever 31 and an additional roll 36 is arranged in the area of the pivoting point 32, the axis of which connects the two levers 31, 31'. Respectively one deflection roll 35 and one roll 36 are thus arranged between two levers 31, 31' and deflect a belt 37. The first belt feeder 30 thus comprises at least two levers 31, 31' between which a belt 37 is arranged. The levers 31, 31' can be pivoted via the adjustment means 33 with the head 34 toward the intake opening 24 that holds the winding core 25, wherein the levers 31, 31' have a concave recess on one side to create space for the winding of the material web 2 with increasing diameter.

The second belt feeder 40 also comprises at least two levers 41, 41' between which the belt 37 is arranged. Each lever 41, 41' is provided on one end with a head 44 and a pressure element 38, also taking the form of a spring plate in this case. The pressure element 38 can also be arranged between two levers 41', 41". A deflection roll 45 is furthermore arranged on each head 44 which connects two levers 41, 41' and functions to deflect the belt 37. An adjustment means 43 in the form of a pneumatic cylinder is arranged at the other end of each lever 41, 41' which can pivot the lever 41 around a pivoting point 42. A roll 46 is furthermore arranged at the pivoting point 42, the axis of which connects the two levers 41, 41', across which the belt 37 is guided. For this exemplary embodiment, the lever is also embodied as a two-sided lever which can, however, be pivoted around two spaced-apart coupling joints in the form of a four-bar linkage, so that the head 44 of the lever 41 realizes a defined pivoting movement which will be explained later on.

The belt 37 moves through the first and second belt feeder 30, 40 and, in the process, is guided via the deflection rolls 35 and 45 to the rolls 36 and 46. From there, the belt 37, which is embodied as endless belt and/or as a flat belt, moves to a drive roll 26 and a belt tensioner 27. The drive roll 26 optionally drives the belt in one direction or the other, depending on the feeding direction for the material web 2. The belt tensioner 27 ensures a sufficient tension between a parked position and a winding position for the feeder system 20. FIG. 3 shows the feeder system 20 and the course of the belt 37 around the inserted winding core 25. Starting from the deflection rolls 45 and 35, the belt 37 in this case wraps itself at least partially also around the winding core 25. With a removed winding core 25, the belt 37 connects the deflection rolls 45 and 35 over the shortest distance (dashed line).

Figure 4:
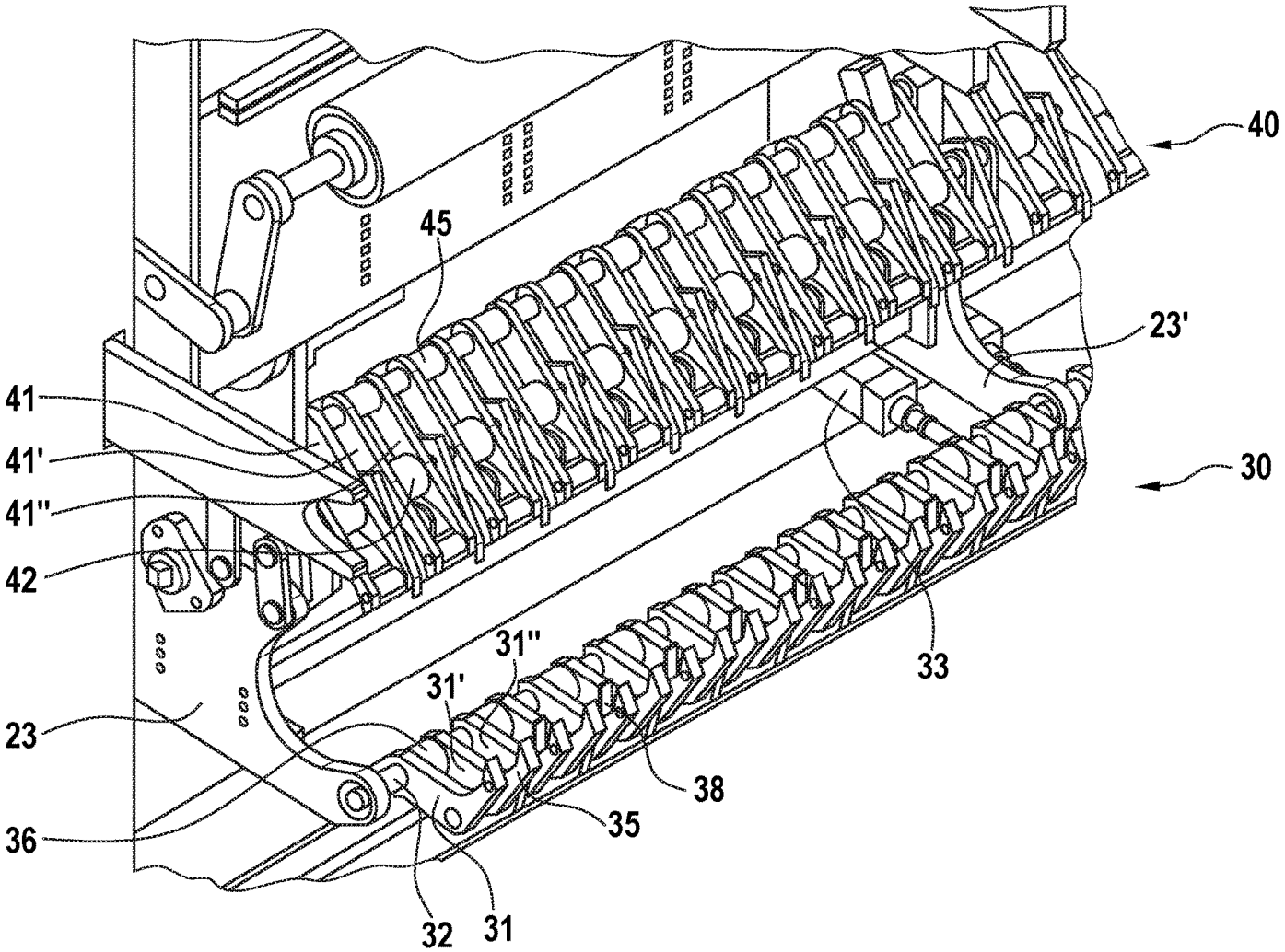
FIG. 4 is an enlarged detail of the view in FIG. 1.

Even if only one or two levers 31, 31' and/or 41, 41' are mentioned in the three preceding paragraphs, FIGS. 1 and 4 clearly show that the feeder system 20 with the first and the second belt feeder 30, 40 comprises a plurality of levers 31, 31', 31", 41, 41', 41" with belts 37 arranged in-between. The number of levers and belts depends on the width of the web material for winding, which can measure up to 3 m. A further aspect of configuring the feeder system 20 with the number of levers and belts is the sensitivity of the material web to be processed. The levers with the pressure elements 38, 48 arranged on their heads press elastically onto the material web 2. The belts 37 are also elastic and flexible over their widths making it possible to wind the material web 2 onto the winding core 25. In contrast to the prior art with the contact rolls or the winding baskets, the differing tension of the material web 2 can adapt over the width of the many belts, and/or owing to the elasticity of the belts with the belt tensioners, the tension across the width of the material web is not applied uniformly onto the material web since the web can have a differing thickness locally owing to the production method.

Shown in FIG. 1, and enlarged in FIG. 4, is the arrangement of the three support plates 23, 23' and 23" between which the levers, rolls and deflection rolls are arranged. As can be seen, the rolls 36 and/or 46, as well as the deflection rolls 35 and/or 45, respectively arranged between two levers, are arranged on one or two joint axes which are not shown herein and are arranged between the support plates 23 and 23' and/or 23' and 23".

According to FIG. 3, the feeder system 20 is opened for the "feeding from above" of the material web to form a coil. For this, the adjustment means 33 and 43 pull the levers 31, 41 downward, so that the heads 34 and 44 are pivoted away from the winding core 25 because of the pivoting point 32 and 42. The first and the second belt feeders 30, 40 thus release the winding core 25. The belt 37 only partially moves around the winding core 25. According to FIG. 2, the material web 2 is conducted over the clamping roll 3 and the roll 4 to the guide rolls 5, 6 and from there is guided via the roll 11 into the feeder system 20. In the process, the material web 2 enters the feeder system 20 from above, meaning in clockwise direction, to wind around the winding core 25. The first belt feeder 30 remains in the opened position. The belt or the belts 37 grip the material web 2 and guide it around the winding core 25. So that the material web 2 realizes a complete rotation around the winding core 25, the second belt feeder 40 fits itself against the winding core 25. For this, the adjustment means 43 presses the lever 41 onto the winding core 25, thus causing the belt 37 to push more against the winding core 25 and the pressure elements 48 to press the material web 2 against the winding core 25. The belt 37 thus wraps itself around the winding core 25 with a wrapping angle of more than 270°. So that the starting portion of the material web 2 is guided completely, if possible, the spring plates rest in the manner of fingers on the material web 2 and press this material web 2 onto the winding core 25. Once a predetermined length of a material web 2 to be wound is reached, the second belt feeder 40 can be pivoted once more to the open position. Owing to two coupling links 47, the lever 41 can only realize a limited pivoting movement, so that the diameter is limited up to which the material web 2 is pressed against the winding core 25 by the second belt feeder 40. For this exemplary embodiment, a diameter of 110 mm, for example, cannot be exceeded for winding the material web 2 around the winding core 25. A cutting device 14 (see FIG. 2) can cut the material web 2 following the completion of the winding operation and once a predetermined length is reached.

Figure 5:
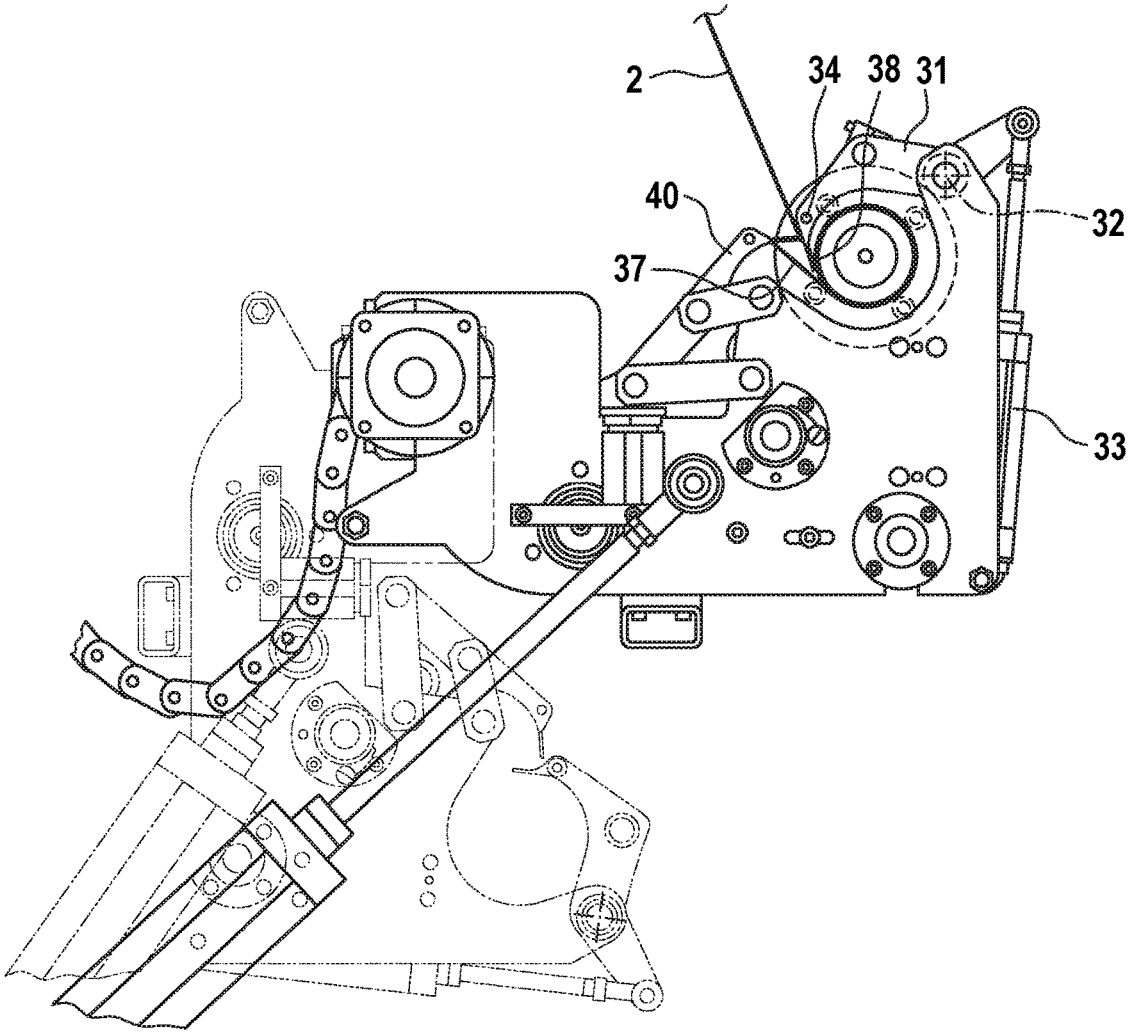
FIG. 5 is a further representation of a detail of the feeder system.

Feeding the material web 2 "from below" takes place as previously described in connection with FIG. 3 by opening the feeding system 20. For this, the adjustment means 33 and 43 pull the levers 31, 41 downward, so that via the pivoting points 32 and 42, the heads 34 and 44 are pivoted away from the winding core 25. The first and the second belt feeders 30, 40 thus release the winding core 25. The belt 37 moves only partially around the winding core 25. According to FIG. 5, the material web 2 enters the feeder system 20 from below, meaning in counter-clockwise direction around the winding core 25. The second belt feeder 40 remains in the opened position. The belt or the belts 37 grip the material web 2 and guide it around the winding core 25. So that the material web 2 executes a complete rotation around the winding core 25, the first belt feeder 30 fits itself against the winding core 25. For this, the adjustment means 33 presses the lever 31 onto the winding core 25, thus causing the belt 37 to fit itself more against the winding core 25 and the pressure elements 38 to press the material web 2 against the winding core 25. The belt 37 thus wraps itself around the winding core 25 with an angle of more than 270°. So that the starting segment of the material web 2 is guided as completely as possible, the pressure elements 38 which are here embodied as spring plates, rest in the manner of fingers on the material web 2 and press the material web against the winding core 25. Once a predetermined length for winding up a material web 2 is reached, the first belt feeder 30 can again be pivoted to the open position. Since the lever 31 is embodied as a two-sided, centrally positioned lever, it can carry out a large pivoting movement, so that a large, variable winding diameter is possible, up to which the material web 2 is pressed by the first belt feeder 30 against the winding core 25. For this exemplary embodiment, a material web 2 can be wound around a winding core 25 up to a diameter of 40-120 mm.

Depending on the strength or rigidity of the material web 2, it can also be supplied for both winding variants via a guide sheet, not shown herein, to the winding core 25.

In contrast to the prior art, both belt feeders 30, 40 can also be operated separately, wherein a material web 2 can be wound clockwise or counter-clockwise around a winding core 25. Two winding directions are therefore possible. As a result of the rotational direction for the winding of the material web 2, the belt feeder 30, 40 is engaged, for which the head 34, 44 points in the winding direction. The second belt feeder 40 points with its head 44 in the direction past the winding core 25 and thus winds up the material web 2 in clockwise direction for the "feeding from above." The first belt feeder 30 points with its head 34 in counter-clockwise direction past the winding core 25 and thus winds up the material web counter-clockwise for the "feeding from below." Even if a belt feeder (30 or 40) is not engaged, its head (34 or 44) functions as a deflection point for the belt 37, so that the wrap-around angle is maximized.

Of course, it is also possible to design the second belt feeder 40 with a changeable lever geometry, similarly as for the first belt feeder 30, so that both belt feeders 30, 40 can realize a variable winding diameter range. The embodiment shown herein, however, has the advantage that because of the limited pivoting range of the second belt feeder 40, the complete feeder system 20 requires less space since, otherwise, the feeder system 20 must be positioned farther from the frame 7 of the winding machine 1, corresponding to the enlarged pivoting range of the levers 41, 41'. The geometric conditions are thus changed since the feeder system 20 can also be pivoted around the pivoting point 21. Corresponding to the different client requirements, a compact winding machine can be provided because of the differing lever system, or a winding machine with variable winding diameter, wherein for both types of embodiment it is possible to wind in two directions.

Corresponding to the embodiment shown in FIG. 1, each belt feeder 30, 40 is provided with a plurality of side-by-side arranged levers and belts. As a result, the tension over the width of the material web can be adapted quite easily. A further advantage is that several strips of material and/or a material web divided into strips can be wound simultaneously.

A further improvement can be achieved in that the deflection rolls 35 and 45 are designed in part to have a diameter large enough so that the deflection rolls 35 and/or 45 on the head 34, 44 of the levers 31, 41 rest on the material web 2 during the winding operation and not the belt 37. The wrapping angle is slightly reduced as a result, but a malfunction due to a jammed belt 37 is no longer possible.

It will be understood that the above description of the present invention is susceptible to various modifications, changes and adaptations, and that the same are intended to be comprehended within the meaning and range of equivalents of the appended claims.

The invention claimed is:

1. A winding machine with a feeder system for winding a material web of foil or film around a winding core, comprising:

at least one circulating belt;

a first belt feeder constructed and arranged to wrap the at least one circulating belt at least partially around the material web during a winding of the material web around the winding core in a first direction; and a second belt feeder constructed and arranged to wind the material web in a second direction around the winding core;

wherein the first and the second belt feeders each comprise at least two levers, and wherein the levers have head ends and further include pressure elements arranged, respectively, in a region of the head ends of the levers.

2. The winding machine according to claim 1, wherein the levers of the first belt feeder are two-sided and centrally positioned.

3. The winding machine according to claim 1, further including two coupling links coupled to the levers of the second belt feeder to limit a pivoting movement of the levers of the second belt feeder.

4. The winding machine according to claim 1, wherein the first belt feeder comprises two-sided, centrally positioned levers and the second belt feeder comprises levers that are positioned via two coupling links to limit a pivoting movement of the levers of the second belt feeder.

5. The winding machine according to claim 1, wherein the winding machine includes a frame and the feeder system is pivotally arranged on the frame of the winding machine.

6. The winding machine according to claim 1, wherein the at least one circulating belt comprises is guided circulating on the first belt feeder and the second belt feeder.

7. The winding machine according to claim 6, wherein the at least one circulating belt is guided between respectively the at least two levers of the first belt feeder and the at least two levers of the second belt feeder.

8. The winding machine according to claim 6, wherein the at least one circulating belt comprises an endlessly circulating belt.

9. The winding machine according to claim 1, further including separate adjustment devices coupled to the first and second belt feeders to separately adjust a pivoting position of the first and second belt feeders.

10. The winding machine according to claim 1, wherein the at least two levers of the first belt feeder have a first pivoting point around which the at least two levers of the first belt feeder are pivotable, and the at least two levers of the second belt feeder have a second pivoting point around which the at least two levers of the second belt feeder are pivotable, and further including one rotating roll which deflects the at least one circulating belt arranged between the at least two levers of the first belt feeder.

11. The winding machine according to claim 1, wherein the at least two levers of the first belt feeder have a first pivoting point around which the at least two levers of the first belt feeder are pivotable, and the at least two levers of the second belt feeder have a second pivoting point around which the at least two levers of the second belt feeder are pivotable, and further including one rotating roll which deflects the at least one circulating belt arranged between the at least two levers of the second belt feeder.

12. A winding machine with a feeder system for winding a material web of foil or film around a winding core, comprising:

at least one circulating belt;

a first belt feeder constructed and arranged to wrap the at least one circulating belt at least partially around the material web during a winding of the material web around the winding core in a first direction; and a second belt feeder constructed and arranged to wind the material web in a second direction around the winding core;

wherein the first and the second belt feeders each comprise at least two levers, wherein the levers of the first and second belt feeders have head ends and further including rotating deflection rolls arranged on the head ends of the levers of the first and second belt feeders.

13. The winding machine according to claim 12, wherein the at least one circulating belt is deflected by the deflection rolls.

14. A winding machine with a feeder system for winding a material web of foil or film around a winding core, comprising:

at least one circulating belt;

a first belt feeder constructed and arranged to wrap the at least one circulating belt at least partially around the material web during a winding of the material web around the winding core in a first direction; and a second belt feeder constructed and arranged to wind the material web in a second direction around the winding core;

wherein the first and the second belt feeders each comprise at least two levers, wherein the levers have head ends and further include pressure elements arranged, respectively, in a region of the head ends of the levers, and wherein the pressure elements comprise spring plates.

* * * * *